United States Patent [19]

Koch et al.

[11] 4,078,415

[45] Mar. 14, 1978

[54] PROCESS OF MANUFACTURING SHAPED BODIES BY COLD SHAPING

[75] Inventors: Friedrich-Karl Koch, Krefeld; Christoph Sieber, Tangstedt Ortsteil Wilstedt; Horst Schmidt, Hamburg, all of Germany

[73] Assignee: Peltzer & Ehlers, Krefeld, Germany

[21] Appl. No.: 753,877

[22] Filed: Dec. 23, 1976

[30] Foreign Application Priority Data

Dec. 23, 1975 Germany ..... 2558119

[51] Int. Cl.[2] ..... B21D 22/00

[52] U.S. Cl. ..... 72/356; 72/354; 72/377

[58] Field of Search ..... 72/354, 356, 377, 352, 72/378; 76/114

[56] References Cited

U.S. PATENT DOCUMENTS

| | | | |
|---|---|---|---|
| 2,368,069 | 1/1945 | Poole et al. | 72/356 |
| 3,101,534 | 8/1963 | Lange | 72/356 X |
| 3,186,209 | 6/1965 | Friedman | 72/356 X |
| 3,759,080 | 9/1973 | Sugahara | 72/356 |

*Primary Examiner*—Leon Gilden

*Attorney, Agent, or Firm*—Herbert E. Kidder

[57] ABSTRACT

A process for producing shaped bodies which are essentially hollow with particularly configured cavities at each end of the body. The process includes a unique step of simultaneously forming the final configured cavity at one end of the body and reducing the exterior diameter of the same end of the body.

6 Claims, 5 Drawing Figures

PROCESS OF MANUFACTURING SHAPED BODIES BY COLD SHAPING

BACKGROUND OF THE INVENTION

The invention relates to a process of manufacturing shaped bodies having cavities provided at both ends of the finished body as well as different outside diameters at both body ends. Such shaped bodies may be, for example, socket wrenches with different wrench widths at their two ends.

As a rule, such shaped bodies are manufactured by cold shaping from cylindrical metal pieces, designated hereinafter both in the initial form and in the intermediate forms to the finished product as stamped part, for short. This stamped part is shaped in several stamping stages, with different stamping tools which comprise in particular bottom dies and press rams.

It is known to carry out in each stamping stage only one stamping operation. It is further known to combine in one stamping stage also two shaping operations insofar as it involves the use of forward and backward extrusion cupping. In forward extrusion cupping the stamped part is pressed from behind over a stationary cupping ram, so that the material of the stamped part flows over the stationary cupping ram in the direction of the pressure exerted from behind.

In backward extrusion cupping, instead, the material of the stamped part flows counter to the direction of the exerted pressure over a movable cupping ram exerting the pressure.

SUMMARY OF THE INVENTION

The object underlying the invention is, in the above described cold shaping process, which also provides a reduction of the outside diameter, to simplify (sic) by the use of fewer stamping steps.

This problem is solved in that in the stamping step in which a forward and a backward extrusion cupping takes place also the outside diameter is reduced.

According to a further feature of the invention, it is provided that, in the aformentioned stamping step with forward and backward extrusion cupping as well as reduction of the outside diameter, first the stamping part is pushed by means of a movable cupping ram over a reducing die onto a stationary cupping ram whose flow edge lies inside the reducing die during forward extrusion cupping, and that after completion of the reducing and forward extruding the movable cupping ram is pressed into the stamped part and is shaped during backward extrusion cupping.

The above described process is suitable in particular for the manufacture of socket wrenches, the stamped part being precupped on one side in a first stamping step, in a second stamping step the finished wrench form is molded into the precupped side during backward extrusion, and in a third stamping step the finished wrench side is extended during backward extrusion and the untooled side is precupped. According to the invention, in the fourth stamping step the precupped side of the stamped part is reduced in outside diameter and the finished wrench width here provided is formed on and the other side of the stamped part extended during backward extrusion.

In a fifth stamping step then further the material bridge existing between the wrench cavities on both sides can be pushed through.

The invention is explained in greater detail in the drawing in the example of the individual process steps for the socket wrench manufacture.

DETAILED DESCRIPTION OF THE INVENTION

Figure 1:
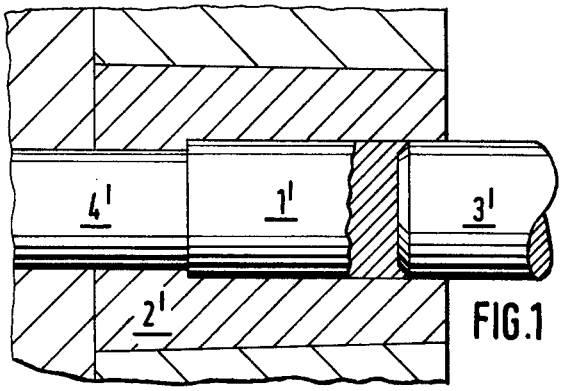
FIG. 1 shows the first stamping step
FIG. 2, the second stamping step
FIG. 3, the third stamping step
FIG. 4, the fourth stamping step
FIG. 5, the fifth stamping step.

According to FIG. 1, the stamped part 1′ is inserted in a bottom die 2′ and precupped by a movable cupping ram 3′. The other, untooled side of the stamped part 1′ rests against a stationary counter-retention 4′.

Figure 2:
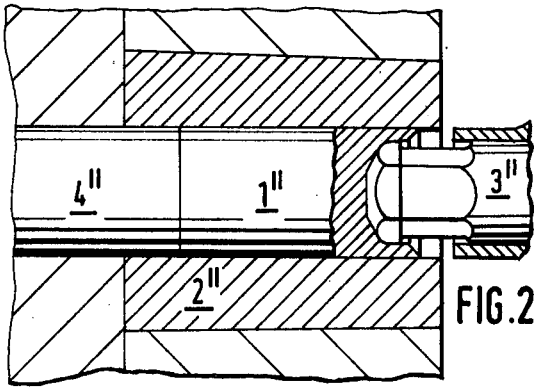

In the second stamping step according to FIG. 2, the stamped part 1″ also rests against a fixed counter-retention 4″ inside the bottom die 2‴. However, the counter-retention 4″ is set back somewhat relative to the first stamping step. In this second stamping step, a movable cupping ram 3″ in the form of a hexagon is inserted in the precupped end, so that here during backward extrusion the finished wrench part is formed on the hexagonally shaped movable cupping ram.

Figure 3:
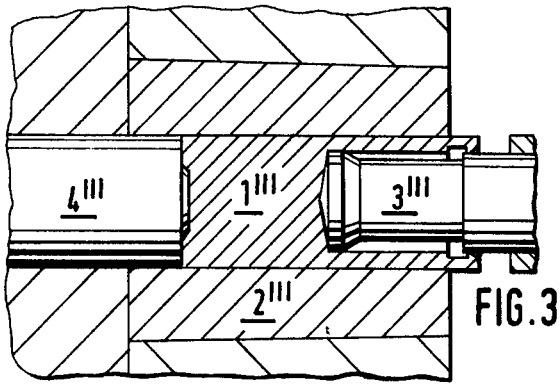

In the third stamping step according to FIG. 3, again by a movable cupping ram 3‴ the finished wrench side is extended during backward extrusion. Again the stamped part 1‴ bears against a fixed counter-retention 4‴, which is here designed as a cupping ram for precupping. Thus, simultaneously with the insertion of the cupping ram 3‴ into the stamped part 1‴ and the backward extrusion brought about thereby, the previously untooled side is precupped.

Figure 4:
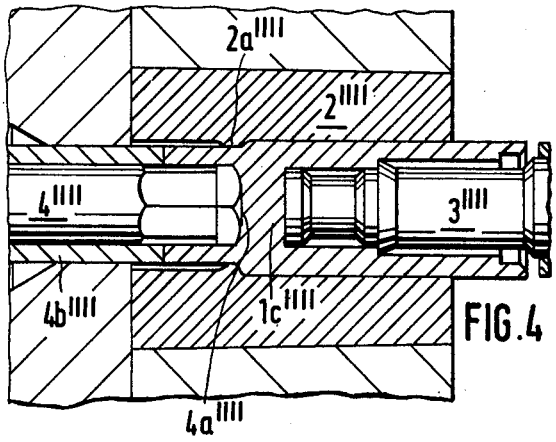

In the fourth stamping step shown in FIG. 4, which shows the essence of the actual invention, three shaping operations are combined in one stamping step. For this the stamped part 1⁗ is inserted by the cupping ram 3⁗ into the bottom die 2⁗. The bottom die 2⁗ has a reducing die 2*a*⁗, through which the cupping ram 3⁗ pushes the stamped part 1⁗ with the reduction of the outside diameter.

Inside the reducing die 2*a*⁗ are located the flow edges 4*a*⁗ of a stationary cupping ram 4⁗. Thus, as the cupping ram 3⁗ pushes forward, simultaneously with the reduction the stamped part 1⁗ is pushed onto the stationary cupping ram 4⁗ during forward extrusion and hence also on this side the internal hexagon is formed on.

As soon as during forward extrusion the stamped part 1⁗ comes to lie against the stationary abutment 4*b*⁗, upon further penetration of the cupping ram 3⁗ the material of the stamped part 1⁗⁗⁗ starts to flow backward over the cupping ram 3⁗⁗⁗, so that this side is extended to the desired dimension.

The combination of the three process steps — reducing, forward extruding and backward extruding — in one stamping step has become possible only through the fact that the flow edge 4*a*″ lies inside the reducing die 2*a*⁗⁗⁗.

Figure 5:
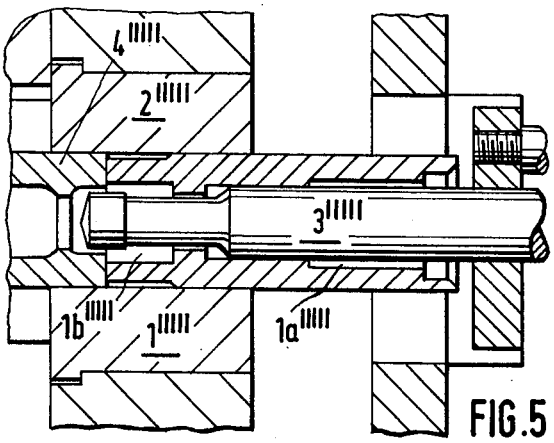

According to FIG. 5, in the fifth stamping step then only the material bridge 1*c*⁗ present between the wrench cavities 1*a*⁗ and 1*b*⁗ on both sides (see FIG. 4) is pushed through. For this an appropriate movable stamping ram 3⁗ is introduced into the stamped part 1⁗, the latter applying against a tubular counter-retention 4'''', through which the removed bridge part can be ejected.

What is claimed is:

1. A method of manufacturing shaped bodies from a stamped part by cold shaping with a series of dies and rams wherein said bodies have a cavity established at each end of the finished hollow body with a different outside diameter at each end, said method comprising the steps of:

precupping the first end of said part in one of said series of dies;

precupping the second end of said part in a further one of said series of dies;

simultaneously forwardly extruding said second end of said part and forming a reduced outside diameter on said second end of said part in another of said series of dies, said second end being completely cupped; and rearwardly extruding said first end of said part in said another of said series of dies, said first end being completely cupped as a result of the operation in the said series of dies.

2. A method according to claim 1 and additionally comprising the step of pushing completely through the material bridge existing between the cupped first end of said body and the cupped second end of said body.

3. A method according to claim 1, wherein said simultaneous forward extruding and reduced diameter forming step comprises pushing said second end of said stamped part by means of a movable cupping ram through a reducing die onto a fixed cupping ram whose flow edge lies inside the reducing die.

4. A method according to claim 3, wherein said rearward extruding step comprises pressing said movable cupping ram into the stamped part.

5. A method according to claim 1, wherein said simultaneous forward extruding and reduced diameter forming step forms one complete end of a socket wrench.

6. A method according to claim 5, wherein said rearward extruding step forms a second complete end of said socket wrench.

* * * * *